US007273001B2

(12) United States Patent
Dekel

(10) Patent No.: US 7,273,001 B2
(45) Date of Patent: Sep. 25, 2007

(54) MODULAR LAUNCH-CELL SYSTEM

(75) Inventor: Ehud Dekel, Nofit (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 83 days.

(21) Appl. No.: 11/159,171

(22) Filed: Jun. 23, 2005

(65) Prior Publication Data

US 2007/0006722 A1 Jan. 11, 2007

(30) Foreign Application Priority Data

Jun. 23, 2004 (IL) ..... 162703

(51) Int. Cl.
*F41F 3/04* (2006.01)

(52) U.S. Cl. ..... 89/1.8; 89/1.801; 89/1.804; 89/1.805

(58) Field of Classification Search ..... 89/1.8, 89/1.801, 1.804, 1.805, 1.807, 1.816, 1.817, 89/1.815, 1.802; 244/63
See application file for complete search history.

(56) References Cited

U.S. PATENT DOCUMENTS 4,604,939 A * 8/1986 Hoffmeister et al. ..... 89/1.816
5,452,640 A 9/1995 Bovee
5,682,005 A 10/1997 Crowley
6,125,734 A 10/2000 Yagla
6,691,600 B2 2/2004 Boudreau
6,901,838 B2 * 6/2005 Dieling et al. ..... 89/1.804
7,089,843 B2 * 8/2006 Miller et al. ..... 89/1.806

* cited by examiner

*Primary Examiner*—J. Woodrow Eldred
(74) *Attorney, Agent, or Firm*—Mark M. Friedman

(57) ABSTRACT

A modular launch-cell system for a launch vehicle. The method includes a number of launch-cells, a base and an upper attachment arrangement. The launch-cells include a missile and are arranged in a structure which includes a number of layers, each of the layer includes two or more launch cells. The launch-cells are substantially directly reversibly mechanically connected to the base. One of the launch-cells includes a lower attachment arrangement configured for reversibly mechanically connecting one launch-cell to one or more of the base and another of the launch-cells disposed below the one launch-cell. The upper arrangement is designed for reversibly mechanically connecting one launch-cell to another of the launch-cells disposed above the one launch-cell.

11 Claims, 2 Drawing Sheets

MODULAR LAUNCH-CELL SYSTEM

FIELD AND BACKGROUND OF THE INVENTION

The present invention relates to a launch-cell system and, in particular, it concerns a modular launch-cell system.

Of most relevance to the present invention is U.S. Pat. No. 6,125,734 to Yagla, which teaches a modular horizontal launch-cell system. A modular frame structure is assembled to create the launch-cell system. Individual launchable devices can then be inserted into canisters. The canisters are then inserted horizontally into the frame structure. A shortcoming of the aforementioned system is due to the requirement of a frame structure which adds to the bulk, expense and complexity of the system and complicates the loading and unloading process, requiring a horizontal insertion of the canisters.

Also of relevance to the present invention is U.S. Pat. No. 5,682,005 to Crowley, U.S. Pat. No. 6,691,600 to Boudreau, et al. and U.S. Pat. No. 5,452,640 to Bovee, et al. These patents teach inserting launch-cells into a container at the location from where the missiles are to be launched. Bovee, et al. also teaches vertically mounting individual missiles to a base alongside a launch-cell container. A shortcoming of the aforementioned systems is that the launch-cells need to be individually loaded by the soldiers at the battlefield.

There is therefore a need for a launch-cell system, which can be assembled off-site, easily transported to the battlefield, protects the launch-cells from rough handling, which therefore eliminates the need to stiffen each launch-cell against rough handling and does not require soldiers to individually handle the launch-cells at the battle field.

SUMMARY OF THE INVENTION

The present invention is a modular launch-cell system construction and method of operation thereof.

According to the teachings of the present invention there is provided, a modular launch-cell system for a launch vehicle, comprising: (a) a plurality of launch-cells, each of the launch-cells including a missile, the launch-cells being arranged in a structure having a plurality of layers, each of the layers including at least two of the launch-cells; and (b) a base, the launch-cells being substantially directly reversibly mechanically connected to the base, wherein one of the launch-cells includes: (i) a lower attachment arrangement configured for reversibly mechanically connecting the one launch-cell to at least one of the base and another of the launch-cells disposed below the one launch-cell; and (ii) an upper attachment arrangement configured for reversibly mechanically connecting the one launch-cell to another of the launch-cells disposed above the one launch-cell.

According to a further feature of the present invention, the base includes a handling and mounting arrangement configured for use in: (a) lifting and transporting the system; and (b) mounting the system on the launch vehicle.

According to a further feature of the present invention, the launch-cells of one of the layers are only connected via the base.

According to the teachings of the present invention there is also provided a method for loading a missile launcher with missiles, comprising the steps of: (a) substantially directly reversibly mechanically connecting a plurality of individual launch-cells to a base to form a multi-layered launch-cell arrangement having a plurality of layers, each of the layers including at least two of the launch-cells, each of the launch-cells including a missile; (b) mounting the launch-cell arrangement onto a launching vehicle; and (c) launching the missile of each of the launch-cells.

According to a further feature of the present invention, there is also provided the step of replacing an empty one of the launch-cells with a new launch-cell having a missile.

According to a further feature of the present invention, there is also provided the step of replacing one of the launch-cells of the launch cell arrangement with another launch-cell.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a modular launch-cell system construction and method of operation thereof.

The principles and operation of a modular launch-cell system according to the present invention may be better understood with reference to the drawings and the accompanying description.

Figure 1:
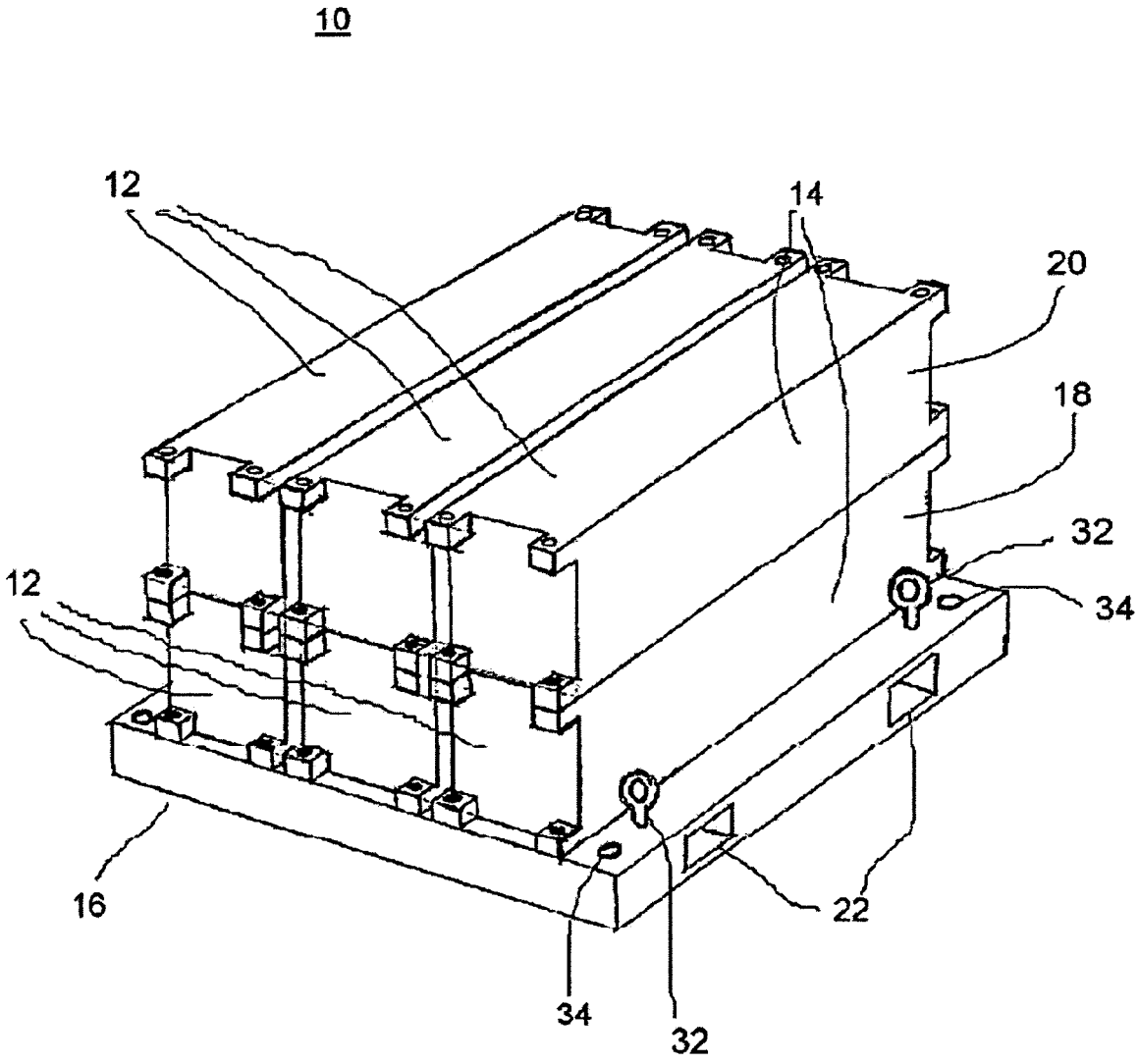
FIG. 1 is a schematic isometric view of a modular launch-cell system that is constructed and operable in accordance with a preferred embodiment of the invention.

Reference is now made to FIG. 1, which is a schematic isometric view of a modular launch-cell system 10 that is constructed and operable in accordance with a preferred embodiment of the invention. Modular launch-cell system 10 includes a plurality of individual launch-cells 12, for example, but not limited to launch tubes or canisters. The term "individual" is defined herein as, each launch-cell 12 being configured to operate independently of any other launch-cell 12. Each launch-cell 12 includes a missile (not shown). A missile is defined herein to include projectiles, rockets, guided missiles and other launchable devices. Launch-cells 12 are arranged in a structure having a plurality of layers 14, a lower layer 18 and an upper layer 20, on a base 16. The length of elongation of launch-cells 12 is parallel to a major surface of base 16. Each layer 14 includes three launch-cells 12. It will be appreciated by those ordinarily skilled in the art that modular launch-cell system 10 can include any plurality of layers and any plurality of launch-cells 12 per layer. Launch-cells 12 are substantially directly reversibly mechanically connected to base 16. The term "substantially directly" is defined herein as, launch-cells 12 having features for direct connection to base 16 and/or other launch-cells 12, such that launch-cells 12 are secured in layers above base 16 without the need of a structural frame for supporting launch-cells 12, for example by inserting or connecting launch-cells 12 to such a frame. The term "substantially directly" does not exclude constructing a canopy having side panels and/or a detachable roof for protecting launch-cells 12, for example, but not limited to, from weather conditions and/or rough handling. The term "substantially direct" is also defined herein to include where adjacent launch-cells 12 are touching each other and/or base 16 or where adjacent launch-cells 12 are not touching each other and/or base 16. The term "reversibly" is defined herein to include mechanically connecting launch-cells 12 such that, launch-cells 12 can be conveniently removed from and reordered in modular launch-cell system 10, or replaced with other launch-cells 12 at a subsequent time. Base 16 has two entry channels 22. Channels 22 extend longitudinally or laterally from one side of base 16 to the other end. Channels 22 are configured such that a forklift truck (not shown) is used to load and unload modular launch-cell system 10 from a ammunition transporter to a launch vehicle or platform. Base 16 includes four eyebolts 32 for hoisting modular launch-cell system 10 with a crane (not shown). Also base 16 includes four tie-down points 34 for securely mounting base 16 on an ammunition transporter (not shown) or launch vehicle (not shown). Channels 22, eyebolts 32 and tie-down points 34 form a handling and mounting arrangement of base 16. Each launch-cell 12 has its own electrical connection, for external electrical input, at the end of launch-cell 12 facing away from the front of the missile within that launch-cell 12.

Figure 2:
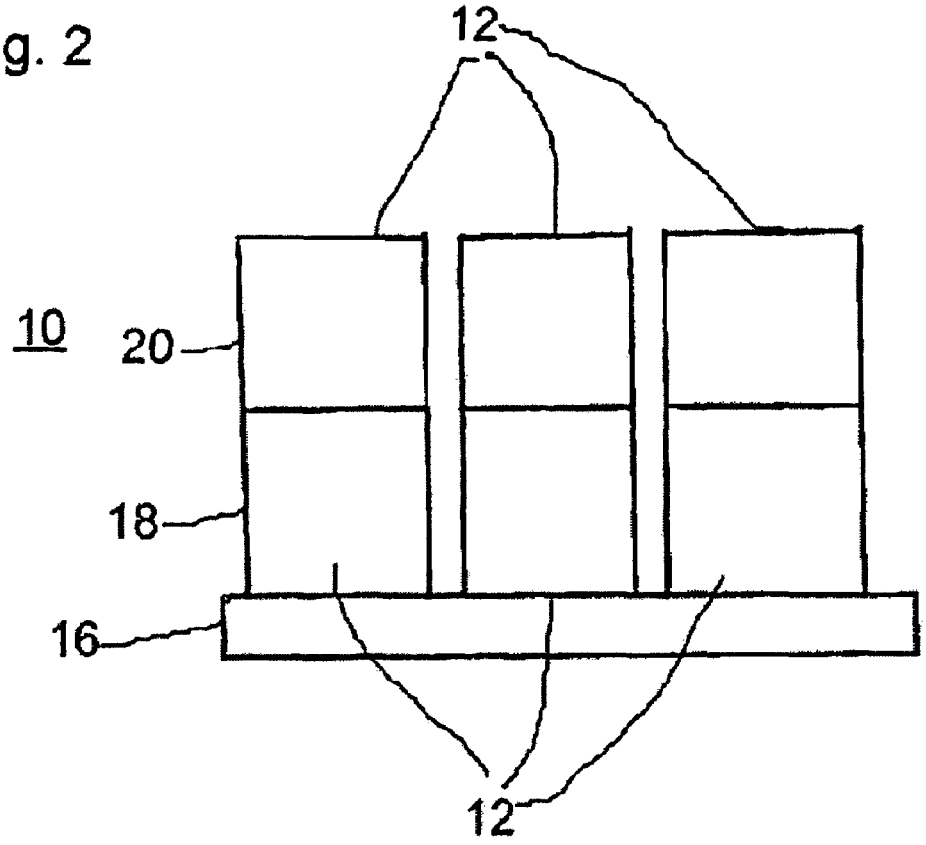
FIG. 2 is a schematic front view of the launch-cell system of FIG. 1 showing how the launch-cells are arranged on the base.

Reference is now made to FIG. 2, which is a schematic front view of modular launch-cell system 10 of FIG. 1 showing how launch-cells 12 are arranged on base 16. Lower layer 18 includes three launch-cells 12 and upper layer 20 includes three launch-cells 12. Launch-cells 12 of lower layer 18 are only reversible mechanically connected to base 16 and to launch-cells 12 of upper layer 20. In other words, launch-cells 12 of lower layer 18 are only connected via base 16. Similarly, launch-cells 12 of upper layer 20 are only mechanically connected to launch-cells 12 of lower layer 18. In other words, launch-cells 12 of upper layer 20 are only connected via base 16. Therefore, if one launch-cell 12 of upper layer 20 needs to be removed, for example due to a defect, then the launch-cell 12 is simply disconnected from lower launch-cell 12 and raised out of modular launch-cell system 10. Similarly, if one launch-cell 12 of lower layer 18 needs to be removed, then the launch-cell 12 directly above the defective launch-cell 12 is removed by being disconnected from the defective launch-cell 12 and the defective launch-cell 12 is removed by being disconnected from base 16. No other launch-cells 12 of modular launch-cell system 10 are involved, thereby making removal or replacement of launch-cells 12 very straightforward.

Figure 3:
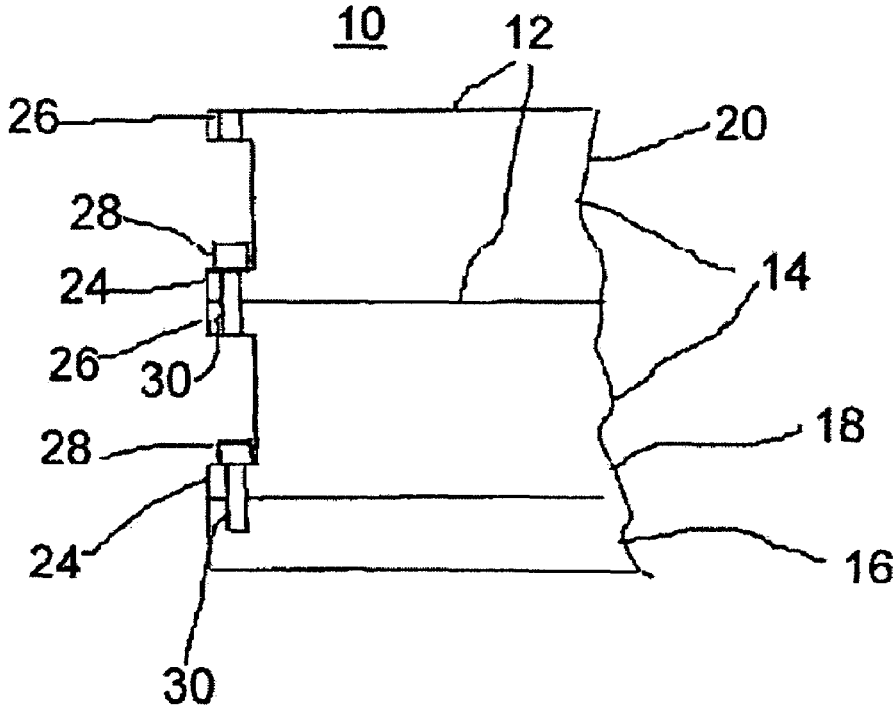
FIG. 3 is a schematic longitudinal cross-sectional view of a section of the launch-cell system of FIG. 1 showing how the launch-cells are mechanically connected.

Reference is now made to FIG. 3, which is a schematic cross-sectional view of a section of modular launch-cell system 10 of FIG. 1 showing how launch-cells 12 are mechanically connected. Each launch-cell 12 includes a lower attachment arrangement 24 configured for reversibly mechanically connecting that launch-cell 12 to base 16 or to another launch-cell 12 disposed below that launch-cell 12. Each Launch-cell 12 also includes an upper attachment arrangement 26 configured for reversibly mechanically connecting that launch-cell 12 to another launch-cell 12 disposed above that launch-cells 12. Lower attachment arrangement 24 typically includes a bolt 28 which screws into a threaded channel 30 of an associated upper attachment arrangement 26 or base 16. For the sake of convenience, layers 14 are described as being "above" or "below" another layer of modular launch-cell system 10. Base 16 is considered to be at the bottom of modular launch-cell system 10 and lower layer 18 and upper layer 20 are "above" base 16, and lower layer 18 is "below" upper layer 20.

In operation, individual launch-cells 12 are substantially directly reversibly mechanically connected to base 16 to form a multi-layered launch-cell arrangement having a plurality of layers 14. Modular launch-cell system 10 is typically assembled and dismantled by skilled ammunition workers, using specialized equipment, in the controlled environment of a factory or an ammunition depot. Modular launch-cell system 10 is loaded onto an ammunition transporter (not shown) by a forklift truck or a crane (not shown) and secured to its cargo bed. The ammunition transporter is driven to the launching vehicle (not shown). Modular launch-cell system 10 is transferred from the ammunition transporter to the launching vehicle by another forklift truck, or crane. Modular launch-cell system 10 is then installed so that missiles of modular launch-cell system 10 can be launched. If any of launch-cells 12 are found to be defective, or a launch-cell is now empty after launching the missile therein, or for any other reason, modular launch-cell system 10 is shipped back to the factory or the depot, where one or more launch-cells 12 are replaced by other launch-cells 12. Alternatively, a launch-cell 12 may be replaced outside the factory, using suitably adequate equipment. The defective launch cell 12 is then mounted on another base 16 for transportation back to the factory or to the depot.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

What is claim is:

1. A modular launch-cell system for a launch vehicle, comprising:

(a) a plurality of launch-cells, each of said launch-cells including a missile, said launch-cells being arranged in a structure having a plurality of layers, each of said layers including at least two of said launch-cells; and (b) a base, said launch-cells being reversibly mechanically connected to said base, wherein at least one of said launch-cells includes: (i) a lower attachment arrangement which reversibly mechanically connects said at least one launch-cell to directly to selectably either said base or directly to another of said launch-cells disposed below said at least one launch-cell; and (ii) an upper attachment arrangement configured for reversibly mechanically connecting said at least one launch-cell directly to another of said launch-cells disposed above said at least one launch-cell.

2. The system of claim 1, wherein said base includes a handling and mounting arrangement configured for use in: (a) lifting and transporting the system; and (b) mounting the system on the launch vehicle.

3. The system of claim 1, wherein said launch-cells of only one of said layers are connected to said base.

4. A method for loading a missile launcher with missiles, comprising the steps of:

(a) reversibly mechanically connecting a plurality of launch-cells to a base to form a multi-layered launch-cell arrangement having a plurality of layers, each of said layers including at least two of said launch-cells, each of said launch-cells including a missile;

wherein at least one of said launch-cells includes: (i) a lower attachment arrangement which reversibly mechanically connects said at least one launch-cell directly to selectably either said base or directly to another of said launch-cells disposed below said at least one launch-cell; and (ii) an upper attachment arrangement configured for reversibly mechanically connecting said at least one launch-cell directly to another of said launch-cells disposed above said at least one launch-cell; and (b) mounting said launch-cell arrangement onto a launching vehicle.

5. The method of claim 4, further comprising the step of replacing an empty one of said launch-cells with a new launch-cell having a missile.

6. The method of claim 4, further comprising the step of replacing one of said launch-cells of said launch cell arrangement with another launch-cell.

7. The system of claim 1 further comprising selectably either a canopy having side panels or a detachable roof for protecting launch-cells.

8. The system of claim 1, without a structural frame for supporting said launch-cells.

9. The system of claim 1, wherein at least two said launch-cells are adjacent and touching directly.

10. A method for loading a missile launcher with missiles, comprising the steps of:

(a) reversibly mechanically connecting a first launch-cell directly to a base, said first launch cell including at least one of the missiles;

(b) reversibly mechanically connecting said first launch-cell directly to a second launch-cell disposed above said first launch-cell; said second launch cell including at least one of the missiles; and (c) mounting the launch-cell arrangement onto a launching vehicle.

11. The method of claim 10, wherein said first and second launch-cells are touching.

* * * * *

UNITED STATES PATENT AND TRADEMARK OFFICE

CERTIFICATE OF CORRECTION

PATENT NO. : 7,273,001 B2
APPLICATION NO. : 11/159171
DATED : September 25, 2007
INVENTOR(S) : Ehud Dekel It is certified that error appears in the above-identified patent and that said Letters Patent is hereby corrected as shown below:

Claim 1, column 4 should be corrected as follows:

Line 42: delete "to" between "launch-cell" and "directly"

Signed and Sealed this

Twenty-fifth Day of December, 2007

JON W. DUDAS
*Director of the United States Patent and Trademark Office*